US010610078B2

(12) United States Patent
Oliveira

(10) Patent No.: US 10,610,078 B2
(45) Date of Patent: Apr. 7, 2020

(54) CARTON WITH ARTICLE ENGAGEMENT FEATURES

(71) Applicant: Graphic Packaging International, Inc., Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 68 days.

(21) Appl. No.: 15/719,814

(22) Filed: Sep. 29, 2017

(65) Prior Publication Data

US 2018/0093799 A1 Apr. 5, 2018

Related U.S. Application Data

(60) Provisional application No. 62/402,332, filed on Sep. 30, 2016, provisional application No. 62/402,331, (Continued)

(51) Int. Cl.

| | |
|---|---|
| ***B65D 5/16*** | (2006.01) |
| ***A47L 13/51*** | (2006.01) |
| ***B65D 5/10*** | (2006.01) |
| ***B65B 43/10*** | (2006.01) |
| ***B65B 5/04*** | (2006.01) |
| ***B65B 7/20*** | (2006.01) |
| ***B65D 5/54*** | (2006.01) |

(Continued)

(52) U.S. Cl.

CPC ..... *A47L 13/51* (2013.01); *A47L 13/38* (2013.01); *A47L 13/50* (2013.01); *B65B 5/04* (2013.01); *B65B 7/20* (2013.01); *B65B 43/10* (2013.01); *B65D 5/0227* (2013.01); *B65D 5/106* (2013.01); *B65D 5/16* (2013.01); *B65D 5/542* (2013.01); *B65D 5/705* (2013.01); *B65D 25/02* (2013.01); *B65D 77/10* (2013.01); *B65D 85/07* (2018.01); *A47L 13/16* (2013.01)

(58) Field of Classification Search

CPC .. B65D 85/07; B65B 5/04; B65B 7/20; B65B 43/10; B65B 5/0227; B65B 5/106; B65B 5/16; B65B 5/542; B65B 5/705; B65B 25/02; B65B 77/10

See application file for complete search history.

(56) References Cited

U.S. PATENT DOCUMENTS

| | | | |
|---|---|---|---|
| 978,569 | A | 12/1910 | Elkin |
| 1,651,848 | A | 12/1927 | Stevens |

(Continued)

FOREIGN PATENT DOCUMENTS

| | | |
|---|---|---|
| DE | 196 42 571 | 5/1997 |
| DE | 203 17 334 | 2/2004 |

(Continued)

*Primary Examiner* — Corey N Skurdal

(74) *Attorney, Agent, or Firm* — Womble Bond Dickinson (US) LLP

(57) ABSTRACT

A carton for holding at least one article. The carton has a plurality of panels that extends at least partially around an interior of the carton. At least one end flap is respectively foldably connected to a respective panel of the plurality of panels for at least partially closing an end of the carton. An engagement structure is attached to at least one panel of the plurality of panels. The engagement structure is positioned for receiving the at least one article and activating the at least one article.

43 Claims, 13 Drawing Sheets

Related U.S. Application Data filed on Sep. 30, 2016, provisional application No. 62/402,320, filed on Sep. 30, 2016.

(51) Int. Cl.

| | |
|---|---|
| ***A47L 13/50*** | (2006.01) |
| ***A47L 13/38*** | (2006.01) |
| ***B65D 85/07*** | (2017.01) |
| ***B65D 5/02*** | (2006.01) |
| ***B65D 5/70*** | (2006.01) |
| ***B65D 25/02*** | (2006.01) |
| ***B65D 77/10*** | (2006.01) |
| *A47L 13/16* | (2006.01) |

(56) References Cited

U.S. PATENT DOCUMENTS

| | | | | |
|---|---|---|---|---|
| 1,667,376 | A | 4/1928 | Fehrenkamp | |
| 1,824,862 | A | 9/1931 | Young | |
| D115,651 | S | 7/1939 | Ford et al. | |
| D120,673 | S | 5/1940 | Jung | |
| 2,312,595 | A | 3/1943 | Smith | |
| 2,348,378 | A | 5/1944 | Goodyear | |
| 2,363,861 | A | 11/1944 | Goodyear | |
| 2,565,146 | A | 8/1951 | Okon | |
| 2,586,301 | A | 2/1952 | Castle | |
| 2,737,326 | A | 3/1956 | Toensmeier | |
| 2,764,284 | A | 9/1956 | Arneson | |
| 2,794,585 | A | 6/1957 | Wagner | |
| 2,950,041 | A | 8/1960 | Stone | |
| 2,967,610 | A | 1/1961 | Ebert et al. | |
| 3,013,710 | A | 12/1961 | Kronson et al. | |
| 3,107,039 | A | 10/1963 | Painter | |
| 3,245,711 | A | 4/1966 | Dantoin | |
| 3,257,027 | A | 6/1966 | Weiss | |
| 3,493,261 | A | 2/1970 | Stout et al. | |
| 3,612,266 | A | 10/1971 | Graser | |
| 3,640,380 | A | 2/1972 | Huffman | |
| 3,722,945 | A | 3/1973 | Wood | |
| 3,767,041 | A | 10/1973 | Graser | |
| D242,901 | S | 1/1977 | Lohrbach | |
| 4,007,869 | A | 2/1977 | Stolkin et al. | |
| 4,008,849 | A | 2/1977 | Baber | |
| 4,039,120 | A | 8/1977 | Herzog | |
| 4,131,198 | A | 12/1978 | Fischer | |
| 4,164,286 | A | 8/1979 | Sutherland | |
| 4,188,766 | A | 2/1980 | Culpepper | |
| 4,192,540 | A | 3/1980 | Oliff | |
| 4,238,069 | A | 12/1980 | Morris, Jr. | |
| 4,326,628 | A | 4/1982 | Wood | |
| 4,336,898 | A | 6/1982 | Joyce | |
| 4,397,393 | A | 8/1983 | Pergande et al. | |
| 4,432,579 | A | 2/1984 | Denmark et al. | |
| 4,438,843 | A | 3/1984 | Graser | |
| 4,489,880 | A | 12/1984 | Calvert | |
| 4,530,459 | A | 7/1985 | Maroszek | |
| 4,566,591 | A | 1/1986 | Turtschan et al. | |
| 4,601,390 | A | 7/1986 | Rosenthal et al. | |
| 4,703,847 | A | 11/1987 | Oliff | |
| 4,815,609 | A | 3/1989 | Kiedaisch | |
| 4,993,625 | A | 2/1991 | Stease et al. | |
| D319,388 | S | 8/1991 | McIntosh, Jr. et al. | |
| 5,135,104 | A | 8/1992 | Jorba | |
| 5,188,225 | A | 2/1993 | Jorba | |
| 5,299,734 | A | 4/1994 | Lane | |
| 5,323,895 | A | 6/1994 | Sutherland et al. | |
| 5,325,992 | A * | 7/1994 | Koller | A47F 13/085 221/33 |
| 5,351,815 | A | 10/1994 | Fogle et al. | |
| 5,400,901 | A | 3/1995 | Harrelson | |
| 5,402,931 | A | 4/1995 | Gulliver et al. | |
| 5,407,065 | A | 4/1995 | Sutherland | |
| 5,439,112 | A | 8/1995 | De Guglielmo et al. | |
| 5,445,262 | A | 8/1995 | Sutherland | |
| 5,484,059 | A | 1/1996 | Sutherland | |
| 5,501,335 | A | 3/1996 | Harris | |
| 5,503,267 | A | 4/1996 | Sutherland | |
| 5,524,814 | A | 6/1996 | Davis | |
| D373,079 | S | 8/1996 | Fahlen | |
| 5,551,556 | A | 9/1996 | Sutherland | |
| 5,582,345 | A | 12/1996 | Lankhuijzen | |
| 5,588,586 | A | 12/1996 | Negelen | |
| 5,595,291 | A | 1/1997 | Negelen | |
| 5,598,920 | A | 2/1997 | Hansen | |
| 5,620,094 | A | 4/1997 | Naumann | |
| 5,638,956 | A | 6/1997 | Sutherland | |
| D386,680 | S | 11/1997 | Johnson | |
| 5,687,838 | A | 11/1997 | Bakx | |
| 5,704,483 | A | 1/1998 | Groh | |
| 5,845,776 | A | 12/1998 | Galbierz et al. | |
| 5,921,392 | A | 7/1999 | Davis | |
| 5,950,912 | A | 9/1999 | Economopoulos | |
| 5,957,289 | A | 9/1999 | Negelen | |
| 5,960,945 | A | 10/1999 | Sutherland | |
| 5,984,086 | A | 11/1999 | Foushee et al. | |
| 6,021,897 | A | 2/2000 | Sutherland | |
| 6,223,892 | B1 | 5/2001 | Bakx | |
| 6,315,111 | B1 | 11/2001 | Sutherland | |
| 6,439,452 | B1 | 8/2002 | Tsao | |
| 6,488,322 | B2 | 12/2002 | Bakx | |
| 6,530,516 | B1 | 3/2003 | Ritter | |
| 6,550,639 | B2 * | 4/2003 | Brown | A47L 13/40 15/1.52 |
| 6,615,984 | B2 | 9/2003 | Saulas et al. | |
| 6,817,484 | B2 * | 11/2004 | Morin | B65D 83/0894 221/48 |
| 6,866,189 | B2 | 3/2005 | Nelson | |
| D525,866 | S | 8/2006 | Oliveira | |
| 7,083,046 | B2 | 8/2006 | Bakx | |
| D532,690 | S | 11/2006 | Oliveira | |
| 7,159,760 | B2 | 1/2007 | Pluck et al. | |
| 7,264,114 | B2 | 9/2007 | Daniel | |
| 7,617,969 | B2 | 11/2009 | Oliveira | |
| 7,621,439 | B2 | 11/2009 | McClure | |
| 7,762,450 | B2 | 7/2010 | Oliveira | |
| 7,793,821 | B2 | 9/2010 | Oliveira | |
| 7,803,726 | B2 | 9/2010 | Policicchio et al. | |
| 8,162,135 | B2 | 4/2012 | Oliveira | |
| 8,225,985 | B2 | 7/2012 | Oliveira | |
| 8,978,889 | B2 | 3/2015 | Fitzwater et al. | |
| 9,487,340 | B2 * | 11/2016 | Castela | B65D 83/0805 |
| 9,533,822 | B2 | 1/2017 | Policicchio | |
| 9,598,202 | B2 | 3/2017 | Oliveira et al. | |
| 9,630,736 | B2 | 4/2017 | Oliveira | |
| 9,840,358 | B2 | 12/2017 | Oliveira | |
| 2002/0108962 | A1 * | 8/2002 | Mangin | A47K 10/42 221/63 |
| 2002/0113449 | A1 | 8/2002 | Bakx | |
| 2003/0106926 | A1 | 6/2003 | Beatificato et al. | |
| 2003/0155264 | A1 * | 8/2003 | Morin | B65D 83/0805 206/494 |
| 2003/0213705 | A1 | 11/2003 | Woog | |
| 2004/0079666 | A1 | 4/2004 | Bakx | |
| 2004/0089656 | A1 | 5/2004 | Watkins | |
| 2004/0200854 | A1 * | 10/2004 | Brickwood | A47F 1/04 221/303 |
| 2004/0226833 | A1 | 11/2004 | Daniel | |
| 2006/0049067 | A1 * | 3/2006 | McDonald | B65D 83/0805 206/233 |
| 2006/0091190 | A1 | 5/2006 | Nikolai | |
| 2007/0000794 | A1 | 1/2007 | Requena | |
| 2008/0202946 | A1 | 8/2008 | Jego | |
| 2010/0307932 | A1 * | 12/2010 | Mezzini | B65D 5/48014 206/38 |

FOREIGN PATENT DOCUMENTS

| | | |
|---|---|---|
| DE | 20 2004 004 248 | 8/2004 |
| DE | 20 2004 017 954 | 2/2005 |
| EP | 0 048 506 | 3/1982 |
| EP | 0 285 043 | 10/1988 |
| EP | 0 398 835 | 11/1990 |
| EP | 0 495 197 | 7/1992 |

(56) References Cited

FOREIGN PATENT DOCUMENTS

| | | |
|---|---|---|
| EP | 0 541 334 | 5/1993 |
| EP | 0 639 504 | 2/1995 |
| EP | 0 780 320 | 6/1996 |
| EP | 1 070 671 | 1/2001 |
| EP | 1 384 679 | 1/2004 |
| EP | 1 661 813 | 5/2006 |
| FR | 1 582 235 | 9/1969 |
| FR | 2 525 992 | 11/1983 |
| FR | 2 664 239 | 1/1992 |
| FR | 2 731 413 | 9/1996 |
| GB | 889 718 | 2/1962 |
| GB | 1 342 180 | 12/1973 |
| GB | 2 085 391 | 4/1982 |
| GB | 2 158 037 | 11/1985 |
| JP | 2004524234 | 12/2004 |
| SE | 140 388 | 5/1953 |
| WO | WO 91/05448 | 4/1991 |
| WO | WO 97/33807 | 9/1997 |
| WO | WO 98/49071 | 11/1998 |
| WO | WO 99/01356 | 1/1999 |
| WO | WO 02/40374 | 5/2002 |
| WO | WO 02/059011 | 8/2002 |
| WO | WO 02/062676 | 8/2002 |
| WO | WO 02/079048 | 10/2002 |
| WO | WO 03/016167 | 2/2003 |
| WO | WO 2005/085091 | 9/2005 |
| WO | WO 2005/095222 | 10/2005 |
| WO | WO 2006/044583 | 4/2006 |
| WO | WO 2006/108098 | 10/2006 |
| WO | WO 2007/044525 | 4/2007 |

* cited by examiner

CARTON WITH ARTICLE ENGAGEMENT FEATURES

CROSS-REFERENCE TO RELATED APPLICATIONS

This application claims the benefit of each of U.S. Provisional Patent Application No. 62/402,320, filed on Sep. 30, 2016, U.S. Provisional Patent Application No. 62/402,331, filed on Sep. 30, 2016, and U.S. Provisional Patent Application No. 62/402,332, filed on Sep. 30, 2016.

INCORPORATION BY REFERENCE

The disclosures of each of U.S. Provisional Patent Application No. 62/402,320, filed on Sep. 30, 2016, U.S. Provisional Patent Application No. 62/402,331, filed on Sep. 30, 2016, and U.S. Provisional Patent Application No. 62/402,332, filed on Sep. 30, 2016 are hereby incorporated by reference for all purposes as if presented herein in their entirety.

BACKGROUND OF THE DISCLOSURE

The present disclosure generally relates to cartons, associated blanks for forming cartons, and methods associated therewith. More specifically, the present disclosure relates to cartons, associated blanks for forming cartons, and associated methods with regard to blanks and cartons that have features for engaging one or more articles stored therein.

SUMMARY OF THE DISCLOSURE

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to one aspect of the disclosure, a carton for holding at least one article comprises a plurality of panels, at least one end flap, and an engagement structure. The plurality of panels extends at least partially around an interior of the carton, and the at least one end flap is respectively foldably connected to a respective panel of the plurality of panels for at least partially closing an end of the carton. The engagement structure is attached to at least one panel of the plurality of panels, and is positioned for receiving the at least one article and activating the at least one article.

According to another aspect of the disclosure, a blank for forming a carton for holding at least one article comprises a plurality of panels, at least one end flap, and an engagement structure. The plurality of panels are for at least partially extending around an interior of the carton formed from the blank, and the at least one end flap is respectively foldably connected to a respective panel of the plurality of panels for at least partially closing an end of the carton formed from the blank. The engagement structure is attached to at least one panel of the plurality of panels, and is positioned for receiving the at least one article and activating the at least one article in the carton formed from the blank.

According to another aspect of the disclosure, a method of forming a carton for holding at least one article comprises obtaining a blank comprising a plurality of panels, at least one end flap respectively foldably connected to a respective panel of the plurality of panels, and an engagement structure attached to at least one panel of the plurality of panels. The engagement structure is positioned for receiving the at least one article and activating the at least one article. The method further comprises folding the plurality of panels to at least partially extend around an interior of the carton, positioning the at least one article in the interior of the carton, and folding the plurality of end flaps to form a closed end of the carton.

According to another aspect of the disclosure, a method of activating an article comprises obtaining a carton holding the article. The carton comprises a plurality of panels that extends at least partially around an interior of the carton, at least one end flap respectively foldably connected to a respective panel of the plurality of panels at least partially closing an end of the carton, and an engagement structure attached to at least one panel of the plurality of panels. The method further comprises accessing the interior of the carton and removing the article, and engaging the article with the engagement structure to activate the article.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons, associated blanks for forming cartons, and associated methods with regard to blanks and cartons that contain one or more articles such as cleaning articles, for example, duster pads, wipes, etc. The articles can be used for cleaning surfaces, and may have a bunched and/or layered arrangement when stored in a carton. The articles can be made from materials suitable in composition for cleaning surfaces and can include, but are not limited to, non-woven layers that may include fibrous polymeric or composite materials, for example, one or more of rayon, viscose, luocell, acetate, triacetate, thermoplastic synthetic polymers including polyester, polypropylene, polyethylene, and composite fibers including cellulose pulp, cotton, hemp, jute abaca, kenaf, sabai grass, flax, esparto grass, straw, bagasse, milkweed floss fibers, and pineapple leaf fiber, or any other suitable material.

Cartons according to the present disclosure can accommodate articles of any shape. In this specification, the terms "lower," "bottom," "upper" and "top" indicate orientations determined in relation to fully erected and upright cartons. As described herein, cartons may be formed by multiple overlapping panels and/or end flaps. Such panels and/or end flaps may be designated in terms relative to one another, e.g., "first", "second", "third", etc., in sequential or non-sequential reference, without departing from the disclosure.

Figure 1:
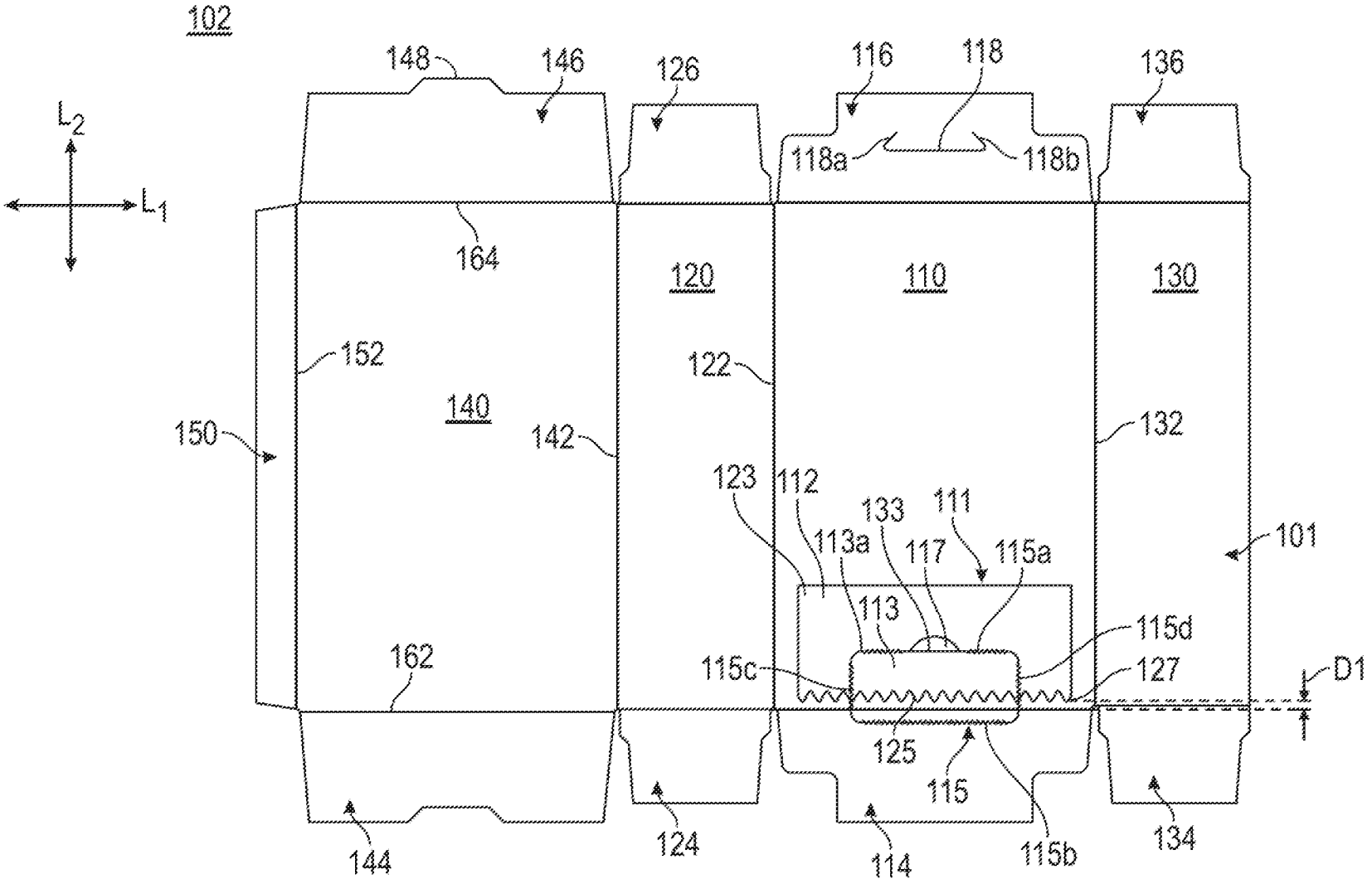
FIG. 1 is a plan view of a blank for a carton according to a first exemplary embodiment of the disclosure.

FIG. 1 is a plan view of an exterior side 101 of a blank 102 that has been obtained for forming a carton 100 (FIG. 2) according to first exemplary embodiment of the disclosure. The carton 100 is for holding a plurality of articles A (FIG. 4) that have a bristled, layered, and/or feathered configuration, for example, duster pads, and the carton 100 has article engagement features 111 to activate (i.e., separate, expand, fluff, and/or actuate), e.g., at least partially move one portion relative to another portion of, one or more articles A upon contact of the one or more articles A with the article engagement features 111. The carton 100 could have various other features without departing from the disclosure.

The blank 102, as shown, has a longitudinal axis L1 and a lateral axis L2. As shown in FIG. 1, the blank 102 includes a front panel 110 foldably connected to a first side panel 120 at a lateral side thereof at a fold line 122. The blank 102 includes a second side panel 130 foldably connected to an opposite lateral side of front panel 110 at a fold line 132. A rear panel 140 is foldably connected to the first side panel 120 at a fold line 142. An attachment panel 150 may be foldably connected to the rear panel 140 at a fold line 152.

As shown, a first end flap 114 and a second end flap 116 are foldably connected to the front panel 110, a first end flap 124 and a second end flap 126 are foldably connected to the first side panel 120, a first end flap 134 and a second end flap 136 are foldably connected to the second side panel 130, and a first end flap 144 and a second end flap 146 are foldably connected to the rear panel 140. When the carton 100 is erected, the end flaps 114, 124, 134, 144 close a first end 107 (FIG. 3) of the carton 100, and the end flaps 116, 126, 136, 146 close a second end 109 (FIG. 3) of the carton 100. In accordance with alternative embodiments of the present disclosure, different flap arrangements can be used for at least partially closing the ends 107, 109 of the carton 100.

In the illustrated embodiment, the end flaps 114, 124, 134, 144 extend along a first marginal area of the blank 102, and are foldably connected to the respective panels 110, 120, 130, 140 at a first longitudinal fold line 162 that extends along the length of the blank 102. The end flaps 116, 126, 136, 146 extend along a second marginal area of the blank 102, and are foldably connected to a respective panel 110, 120, 130, 140 at a second longitudinal fold line 164 that extends along the length of the blank 102. The longitudinal fold lines 162, 164 may be, for example, substantially straight, or offset at one or more locations to account for blank thickness and other factors.

In one embodiment, the end flap 116 includes a tear line 118 for forming a female locking feature or slot and the end flap 146 includes a protrusion 148 for forming a male locking tab. As shown, the tear line 118 can include relief portions 118*a*, 118*b*. Upon opening the carton 100, the end flaps 116, 126, 136, 146 can be folded with the end flap 146 overlapping the end flap 116 and the protrusion 148 pressed against the end flap 116 to tear the tear line 118 and allow insertion of the protrusion 148 through the tear line 118 between portions of the end flap 116 to close and/or reclose the carton 100. The end flaps 146, 116 could have other locking features or the features shown could be otherwise shaped, arranged, configured, and/or omitted without departing from the disclosure.

As shown in FIG. 1, the engagement features 111 of the blank 102 include an access panel 113 at least partially defined by a tear line 115. Each access panel 113 is disposed over and in face-to-face contact with a fitment 112 and an engagement opening 135 (FIG. 4), as described further herein. In one embodiment, the tear line 115 has a first longitudinal portion 115*a* in the front panel 110, a second longitudinal portion 115*b* in the end flap 114, and a first lateral portion 115*c* and second lateral portion 115*d* extending between the ends of the longitudinal portions 115*a*, 115*b*. In the illustrated embodiment, the lateral portions 115*c*, 115*d* of the tear line 115 are in both the front panel 110 and the end flap 114 and a portion of the fold line 162 extends across the access panel 113. In this regard, the access panel 113 includes portions of both the front panel 110 and the end flap 114 and the engagement opening 135 is defined in portions of the front panel 110 and the end flap 114. In the illustrated embodiment, the access panel 113 is generally rectangular, but the access panel 113 and the tear line 115 could be otherwise shaped, arranged, and/or configured without departing from the disclosure. Also, the access panel 113 can be configured to remain foldably connected to the panel 110 or the end flap 114 by replacing one or more of the portions 115*a*, 115*b*, 115*c*, 115*d* of the tear line 115 with a fold line.

As shown in FIG. 1, an aperture 117 in the front panel 110 is adjacent an edge 133 of the access panel 113 that is collinear with the longitudinal portions 115*a* of the tear line 115. The aperture 117 allows the edge 133 of the access panel 113 to be grasped to separate the access panel 113 from the carton 100 at the tear line 115 and to create and/or expose an engagement opening 135 (FIG. 4) of the carton 100. In embodiments, the aperture 117 could be formed by the removal of a tab.

The engagement features 111, as shown, include an engagement structure or fitment 112 attached to an interior surface of the blank 102. In one embodiment, the fitment 112 includes a base 123 adhesively attached to the front panel 110 and a plurality of teeth 125 at an edge 127 of the fitment 112. As shown in FIG. 1, the fitment 112 is positioned so that the teeth 125 are positioned closely adjacent the fold line 162 connecting the end flap 114 and the front panel 110. In one embodiment, the edge 127 of the fitment 112 including the teeth 125 is adjacent but spaced apart from the fold line 162 by a distance D1 that can be at least about 0.25 inches. In the illustrated embodiment, the fitment 112 is sized to be wider than the access panel 113 so that the edge 127 extends across the lateral tear lines 115*c*, 115*d* that define the access panel 113. The teeth 125, as shown, can have a jagged or zig-zag configuration. In embodiments, the teeth 125 could be shaped differently than illustrated, for example, irregular shaped, or replaced with alternative configurations such as spikes, barbs, or hooks, or any other configuration without departing from the disclosure. In other embodiments, the fitment 112 could be otherwise shaped, arranged, and/or positioned without departing from the disclosure.

In one embodiment, the fitment 112 is made of a polymeric material, for example, a rigid plastic material (e.g., APET or other suitable material). The fitment 112 can be material other than plastic (e.g., metal, paperboard, or any other suitable material) and/or could be otherwise configured, e.g., having a flexible and/or resilient configuration, without departing from the disclosure.

Figure 2:
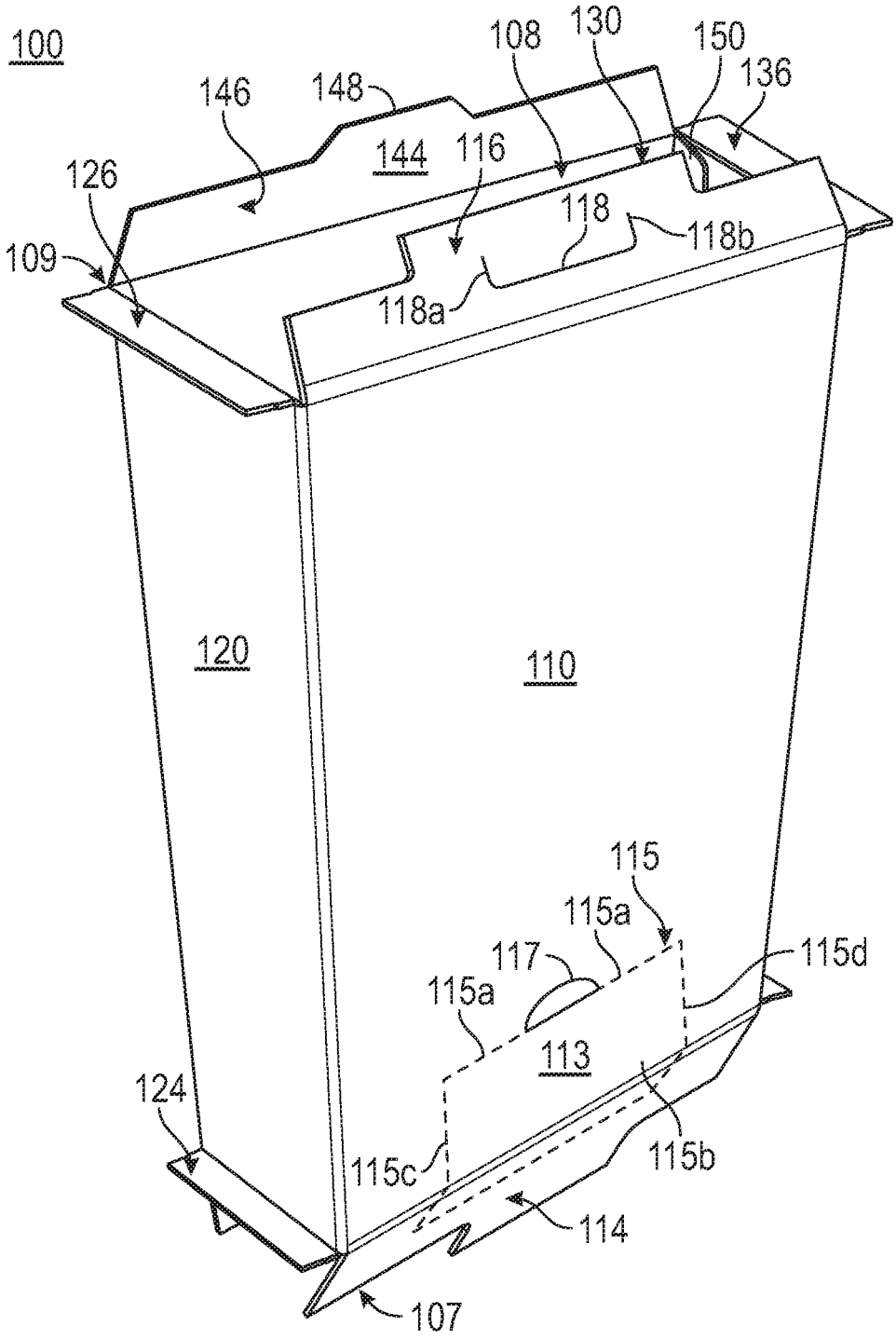
FIG. 2 is a perspective view of a carton assembled from the blank of FIG. 1 in an open configuration according to the first exemplary embodiment of the disclosure.

Still referring to FIG. 1, and referring additionally to FIG. 2, a method of forming the carton 100 from the blank 102 will be described. The carton 100 is illustrated in an open or sleeve-like configuration in FIG. 2, which can be formed by folding the front panel 110, the first side panel 120, the second side panel 130, and the rear panel 140 relative to one another at respective fold lines 122, 132, 142. The attachment panel 150 may be folded at fold line 152 and disposed in substantially face-to-face contact with an interior surface of the second side panel 130 to enclose an interior 108 of the carton 100. The attachment panel 150 may be attached to second side panel 130, for example, with an adhesive such as glue.

Figure 3:
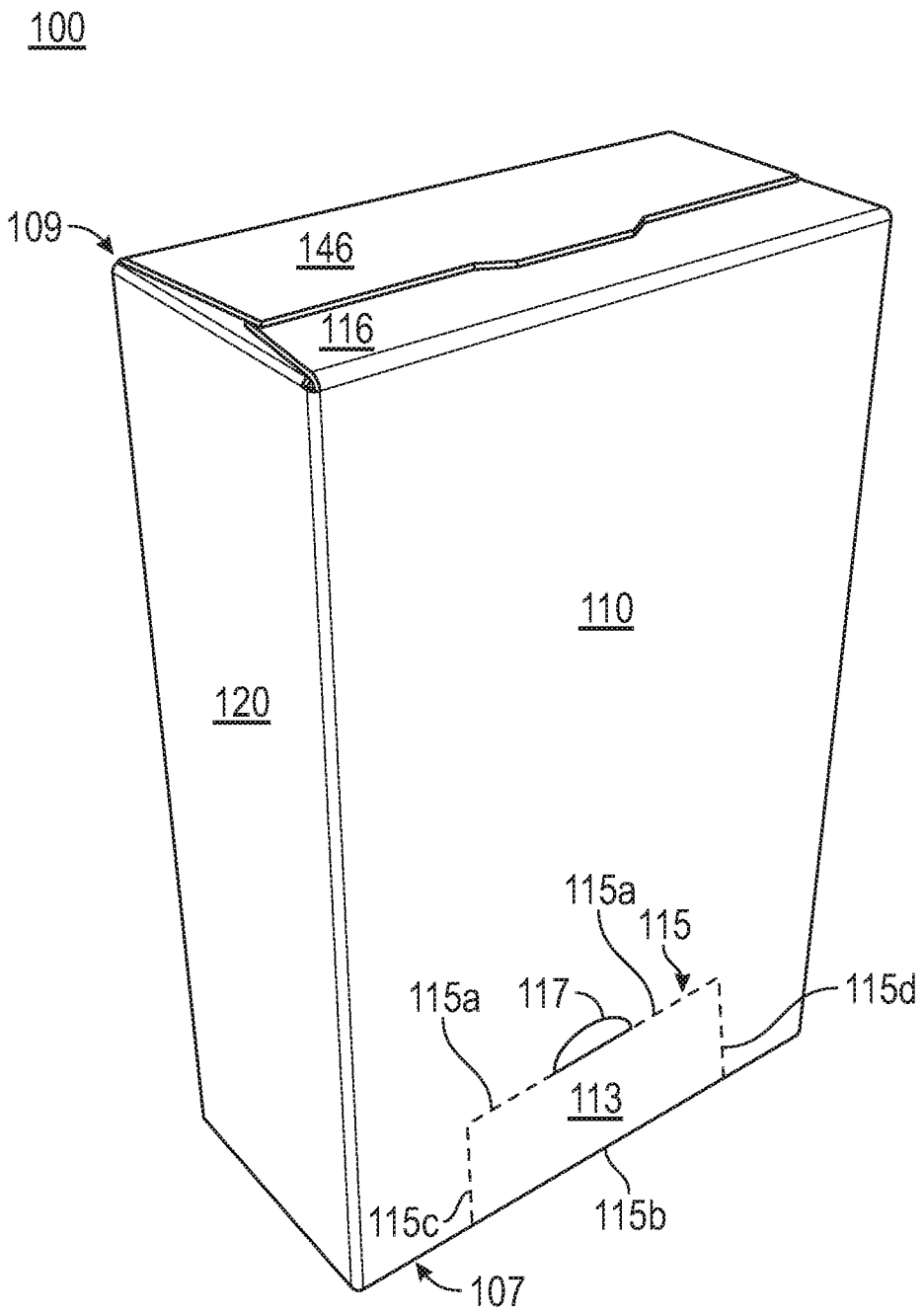
FIG. 3 is a perspective view of the carton of FIG. 2 in a closed configuration.

With additional reference to FIG. 3, the end flaps 114, 124, 134, 144 and the end flaps 116, 126, 136, 146 can be folded at respective fold lines 162, 164 and at least partially overlapped with one another and secured in such an arrangement, for example, through an adhesive or through one or more interlocking features to close a first end 107 and an opposite second end 109 of the carton 100. In an initial closed configuration of the carton 100, the end flap 146 can be overlapped upon the end flap 116 in at least partial face-to-face contact, and can be maintained in such a configuration with an adhesive such as glue. After an initial opening of the second end 109 of the carton 100, the protrusion 148 on the end flap 146 may be at least partially inserted through the tear line 118 on the end flap 116 to provide a releasably locking or reclosable configuration for subsequent openings and closings of the second end 109 of the carton 100. In this regard, protrusion 148 can be selectively engaged and disengaged from the end flap 144 through the tear line 118 to allow selective opening and closing of the second end 109 of the carton 100 to provide access to the interior 108 of the carton 100, for example, to access and/or remove at least one article A (FIG. 4) from the interior 108 of the carton 100.

Articles A (FIG. 4) can be placed or positioned in the carton 100 prior to closing one or both ends 107, 109 such that articles A can be disposed in the interior 108 of the carton 100. Articles A may be disposed in a stacked or other arrangement in the interior 108 of the carton 100. In this regard, the reclosable second end 109 of the carton 100 allows a user to open the second end 109 to remove one or more articles A from the interior 108 of the carton 100 before reclosing the second end 109.

The carton 100 has been described with end flaps 116, 126, 136, 146 forming second end 109 as a top facing end of the carton 100. In the interest of clarity, the following figures will be described with the carton 100 in an inverted orientation relative to FIG. 3 such that the second end 109 is a bottom-facing end of the carton 100. In use, the carton 100 may be used in either orientation to satisfy a user's needs.

Figure 4:
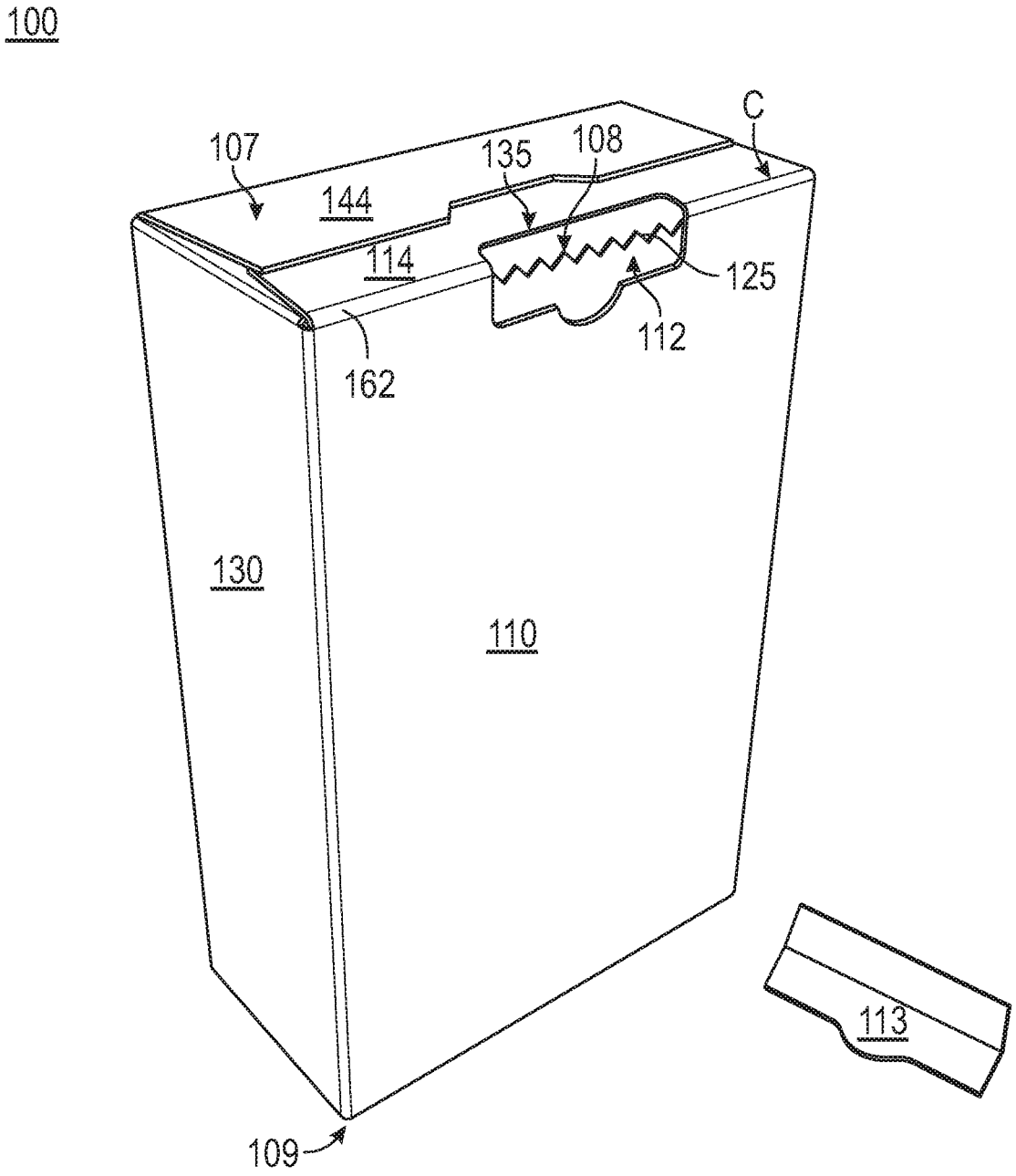
FIG. 4 is a perspective view of the carton of FIG. 3 with an access panel removed.

Still referring to FIG. 1, and with additional reference to FIG. 4, the carton 100 is shown with first end 107 having a top-facing orientation. As described above, a user may insert one or more of his or her fingers and/or a tool into aperture 117 to engage a portion of the access panel 113. Thereafter, a user may remove the access panel 113 along one or more portions 115*a*, 115*b*, 115*c*, 115*d* of the tear line 115, as shown, such that the access panel 113 including portions of the end flap 114 and the front panel 110 is removed. As shown, the carton 100 comprises a corner C between the front panel 110 and the end flap 114 substantially at the fold line 162 such that a portion of the corner C is removed with the access panel 113. In this regard, the engagement opening 135 into the interior 108 of the carton 100 is provided across portions of the first end 107 and the front panel 110 and with the teeth 125 of the engagement features 111 exposed in an upright configuration facing the first end 107 of carton 100. In this regard, the fitment 112 is positioned adjacent the first end 107 of the carton such that the teeth 125 are presented facing upwardly along an exposed edge of the carton 100 when the access panel 113 is removed. In the illustrated configuration of the carton 100, articles A disposed within the interior 108 of the carton 100 may be urged, due to gravity, downwardly and away from the teeth 125 of engagement features 111 such that articles A disposed in the interior 108 of the carton 100 do not interfere with engagement of other objects against the teeth 125 or other portions of engagement features 111 and a substantially free passage is defined in the interior 108 of the carton 100 between portions of the engagement opening 135 in the first end 107 and the front panel 110, as described further herein.

Figure 5:
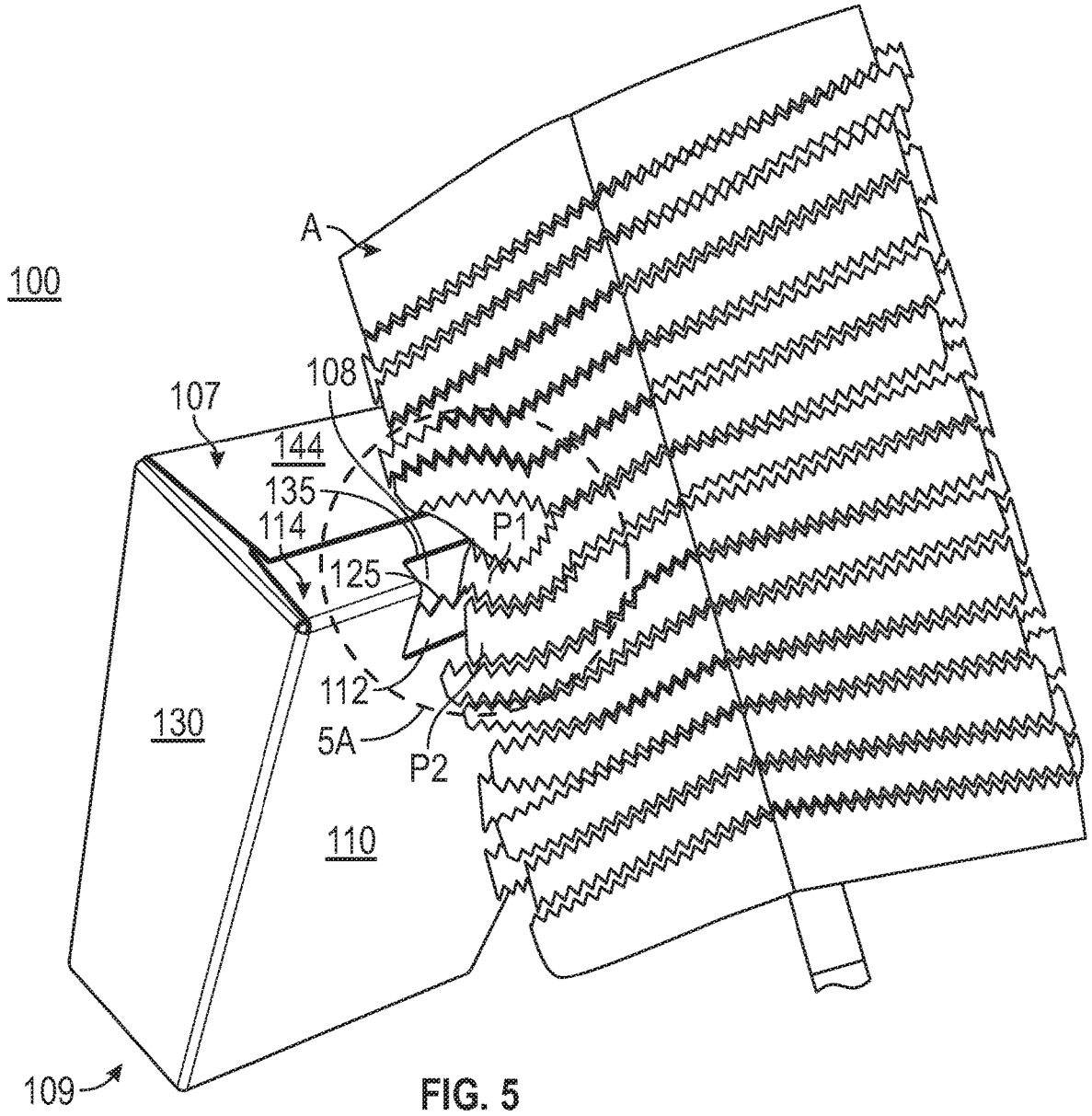
FIG. 5 is a perspective view of the carton of FIG. 4 having an article engaged against a portion of the carton.
Figure 5A:
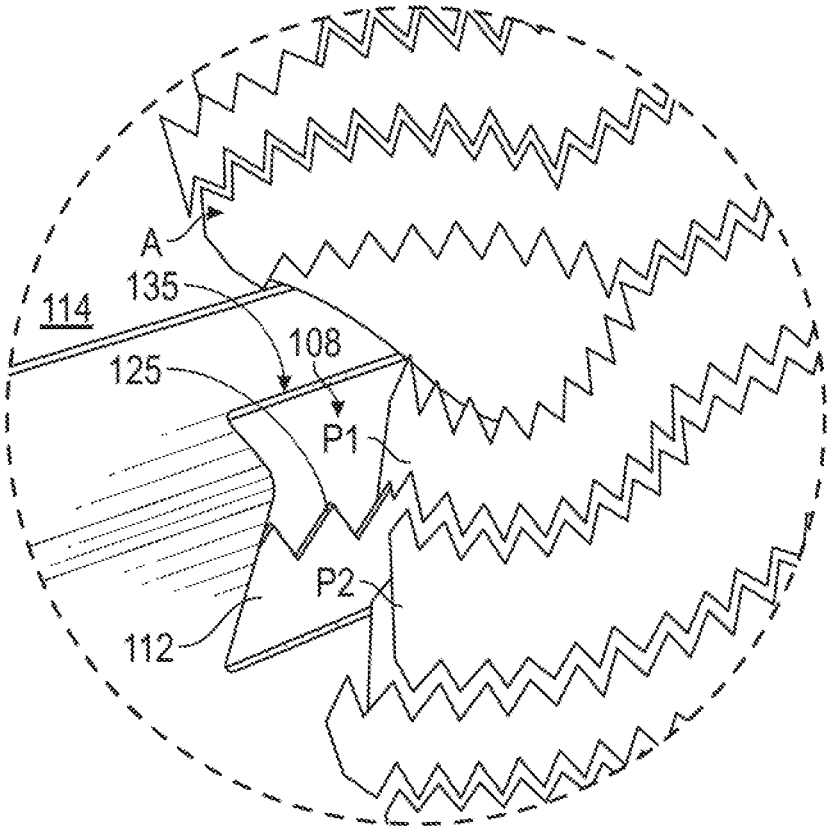
FIG. 5A is a detail view of the area identified in FIG. 5.

Referring additionally to FIGS. 5 and 5A, a method of activating an article A will be described. After having obtained the carton 100 holding the articles A, a user may access the interior 108 of the carton 100, for example, by opening and optionally reclosing the second end 109 of the carton 100 as described above, and retrieve and/or remove one or more articles A from the interior 108 of the carton 100. As shown, the fitment 112 is positioned such that a user may activate one or more articles A by engaging or contacting the article with the teeth 125 of the fitment 112. As shown, the articles A can be disposed on a handle, rod, or other holder for grasping and manipulation by a user. The articles A may have a frangible, separable, and/or expandable configuration such that movement of articles A relative to the teeth 125 causes two or more portions of articles A, e.g., P1 and P2 as shown, to activate (i.e., separate, expand, fluff, and/or actuate) relative to one another. In this regard, the teeth 125 are configured to interengage one or more portions of an article A while allowing one or more other portions of the article A to continue movement therealong. While an article A has been described as substantially being tangentially engaged with the carton 100 against the teeth 125, in embodiments, one or more articles A may be at least partially inserted through the engagement opening 135 and into the interior 108 of the carton 100 in the course of contacting the teeth 125 or other portions of the engagement features 111. In the course of moving an article A against the teeth 125, the article A can be articulated, e.g., disposed at different angles, relative to the teeth 125 such that the article A is at least partially disposed in the interior 108 of the carton 100.

Figure 6:
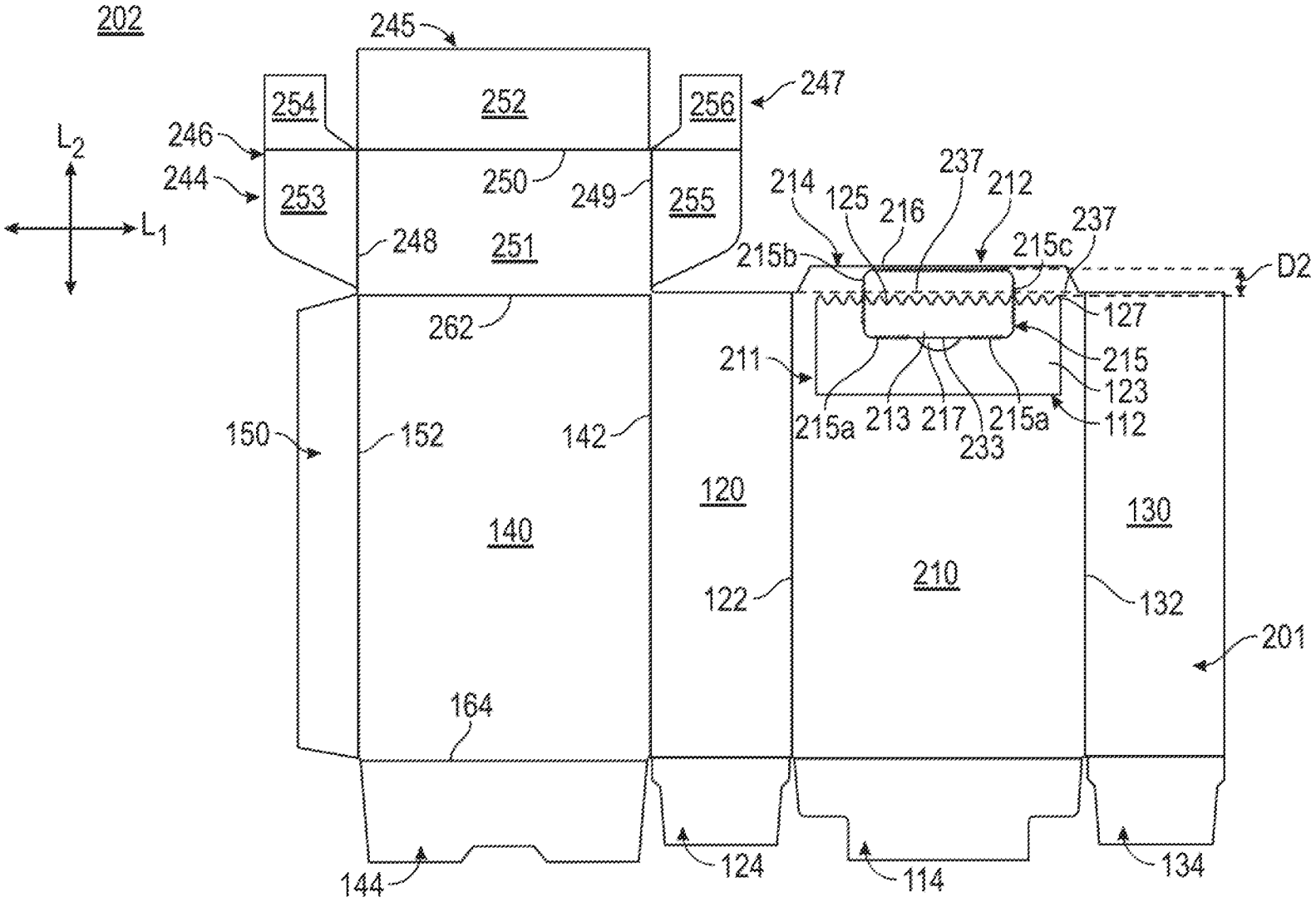
FIG. 6 is a plan view of a blank for a carton according to a second exemplary embodiment of the disclosure.

Referring to FIG. 6, a plan view of an exterior side 201 of a blank 202 that has been obtained for forming a carton 200 (FIG. 7) according to second exemplary embodiment of the present disclosure is generally indicated as 202. The carton 200 is for holding a plurality of articles A (FIG. 9), such as duster pads, and the carton 200 has article engagement features 211 to activate (i.e., separate, expand, fluff, and/or actuate) one or more articles A upon contact of the one or more articles A with the article engagement features 211. The carton 200 could have various other features without departing from the disclosure. Blank 202 may include one or more similar features to blank 102 (FIG. 1) described above, with like features designated with like or similar reference numbers.

Reference will be made herein to a longitudinal axis L1 and a lateral axis L2 of the blank 202. As shown, the blank 202 includes a front panel 210 foldably connected to a first side panel 120 at a lateral side thereof at a fold line 122. The blank 202 includes a second side panel 130 foldably connected to an opposite lateral side of front panel 210 at a fold line 132. A rear panel 140 is foldably connected to the first side panel 120 at a fold line 142. An attachment panel 150 may be foldably connected to rear panel 140 along a fold line 152, as shown.

As shown in FIG. 6, a first end flap 214 is foldably connected to the front panel 210 at a fold line 237. As also shown, a second side end flap 114 is foldably connected to the front panel 210, an end flap 124 is foldably connected to the first side panel 120, an end flap 134 is foldably connected to the second side panel 130, and a first end flap 244 and a second end flap 144 are each foldably connected to the rear panel 140. As described further herein, when the carton 200 is erected, the end flap 244 closes a first end 207 (FIG. 9) of the carton 200, and the end flaps 114, 124, 134, 144 close a second end 209 (FIG. 9) of the carton 200. In accordance with alternative embodiments of the present disclosure, different flap arrangements can be used for at least partially closing the ends 207, 209 of the carton 200.

As shown, the end flap 244 includes a central panel or portion 245 foldably connected to the rear panel 140 at the fold line 262, and lateral panels or portions 246, 247 foldably connected on lateral sides thereof at respective fold lines 248, 249. The portions 245, 246, 247 of end flap 244 each include a portion of a longitudinal fold line 250 extending therealong to facilitate assembly of the carton 200 (FIG. 8), as described further herein. In this regard, the central portion 245 of the end flap 244 includes a proximal portion 251 and a distal portion 252 foldably connected to one another along a portion of the fold line 250, the lateral portion 246 of the end flap 244 includes a proximal portion 253 and a distal portion 254 foldably connected to one another along a portion of the fold line 250, and the lateral portion 247 of the end flap 244 includes a proximal portion 255 and a distal portion 256 foldably connected to one another along a portion of the fold line 250.

As shown, the end flaps 214 and 244 extend along a first marginal area of the blank 202, and the end flap 244 is foldably connected to the rear panel 140 at a fold line 262. The end flaps 114, 124, 134, 144 extend along a second marginal area of the blank 202, and are foldably connected to the respective panels 210, 120, 130, 140 at a second longitudinal fold line 164 that extends along the length of the blank 202. The longitudinal fold lines 237, 250, 262, 264 may be, for example, substantially straight, or offset at one or more locations to account for blank thickness or for other factors.

Still referring to FIG. 6, the engagement features 211 of the blank 202 include an access panel 213 at least partially defined by a tear line 215. In one embodiment, the tear line 215 has a longitudinal portion 215*a* in the front panel 210, and first and second lateral portions 215*b*, 215*c* extending away from the longitudinal portion 215*a* to an edge 216 of the end flap 214. In the illustrated embodiment, the lateral portions 215*b*, 215*c* of the tear line 215 are disposed in portions of both the front panel 210 and the end flap 214. In the illustrated embodiment, the access panel 213 is generally rectangular, but the access panel 213 and the tear line 215 could be otherwise shaped, arranged, and/or configured without departing from the disclosure. Also, the access panel 213 can be configured to remain foldably connected to the front panel 210 or end tab 214 upon separation of the access panel 213 from the front panel 210 at the tear line 215, for example, by replacing one or more of the portions 215*a*, 215*b*, 215*c* of the tear line 215 with a fold line.

Figure 8:
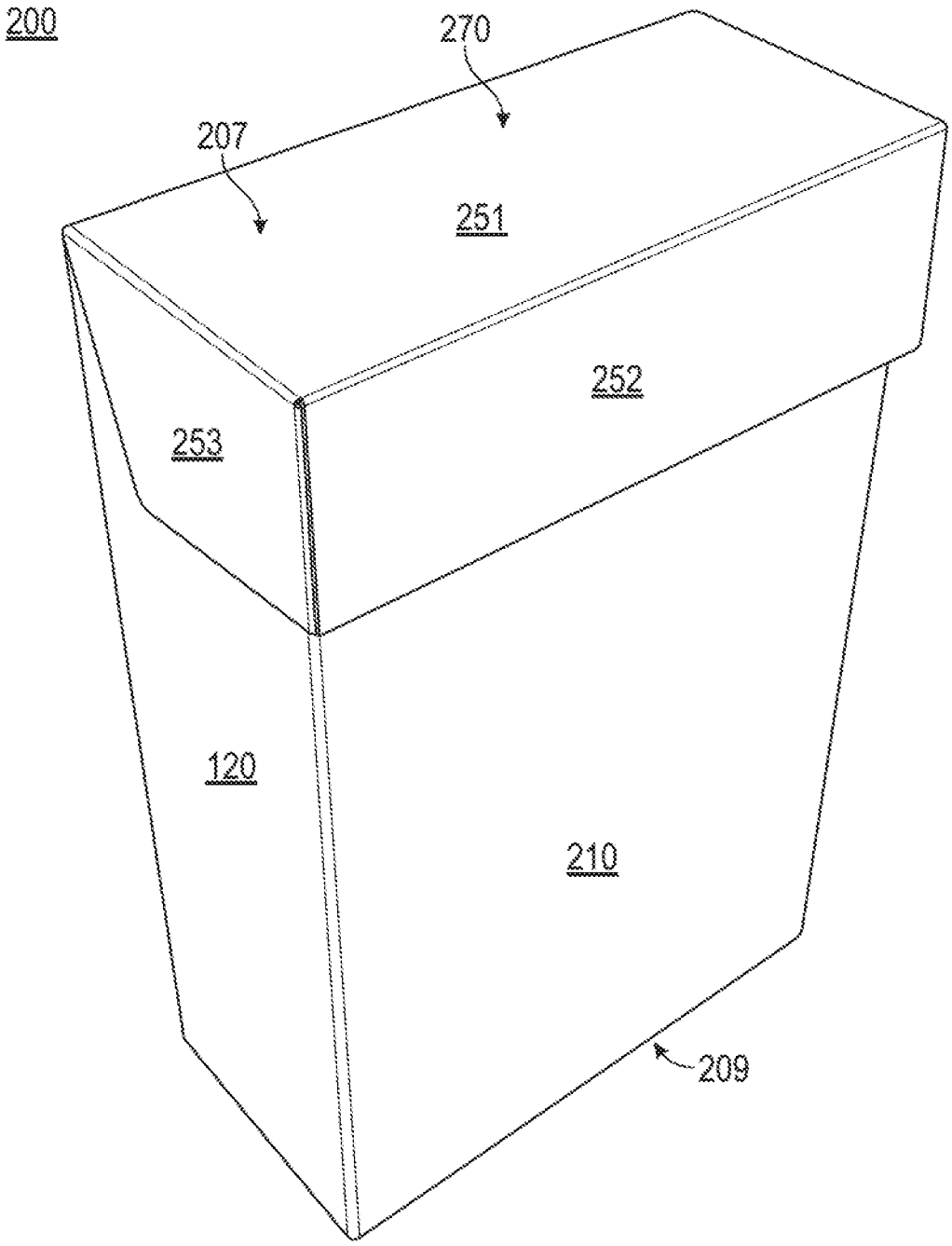
FIG. 8 is a perspective view of the carton of FIG. 7 in a closed configuration.

As shown in FIG. 6, the engagement features 211 include an engagement structure or fitment 112 attached to an interior surface of the blank 202. In one embodiment, the fitment 112 includes a base 123 adhesively attached to the front panel 210 and a plurality of teeth 125 at an edge 127 of the fitment 112*a*. The fitment 112 is positioned, as shown in FIG. 8, so that the teeth 125 are positioned adjacent the fold line 237 facing the end flap 214. In one embodiment, the edge 127 of the fitment 112 including the teeth 125 is adjacent but spaced apart from the outside edge 216 of the end flap 214 by a distance D2 that can be at least about 0.437 inches. In other embodiments, the distance D2 could be a different distance without departing from the disclosure. In the illustrated embodiment, the fitment 112 is sized to be wider than the access panel 213 so that the edge 127 extends across the lateral tear lines 215*b*, 215*c* that define the access panel 213. In embodiments, the fitment 112 could be otherwise shaped, arranged, and/or positioned without departing from the disclosure.

Still referring to FIG. 6, and referring additionally to FIGS. 7 and 8, a method of forming the carton 200 from the blank 202 will be described. The carton 200 is illustrated in an open or sleeve-like configuration in FIG. 7, which can be formed by folding the front panel 210, the first side panel 120, the second side panel 130, and the rear panel 140 relative to one another at the respective fold lines 122, 132, 142. The attachment panel 150 may be folded at the fold line 152 and disposed in substantially face-to-face contact with an interior surface of the second side panel 130 to enclose an interior 208 of the carton 200. The attachment panel 150 may be attached to the second side panel 130, for example, with an adhesive such as glue.

In order to form a reclosable first end 207 of carton 200, the lateral portions 246, 247 of the end flap 244 are folded relative to the central portion 245 of the end flap 244 at respective fold lines 248, 249 such that the proximal portions 253, 255 of the respective lateral portions 246, 247 are substantially parallel to one another and perpendicular to the proximal portion 251 of the central portion 245 of the end flap 244, and the distal portions 254, 256 are folded at respective portions of the fold line 250 such that the distal portions 254, 256 are disposed in substantial face-to-face contact with the distal portion 252 of the central portion 245 of the end flap 244. In this regard, a hinged lid 270 having an at least partially enclosed configuration is formed, and portions of the end flap 244 may be maintained in such a folded arrangement, for example, through an adhesive such as glue or through one or more interlocking features.

Figure 9:
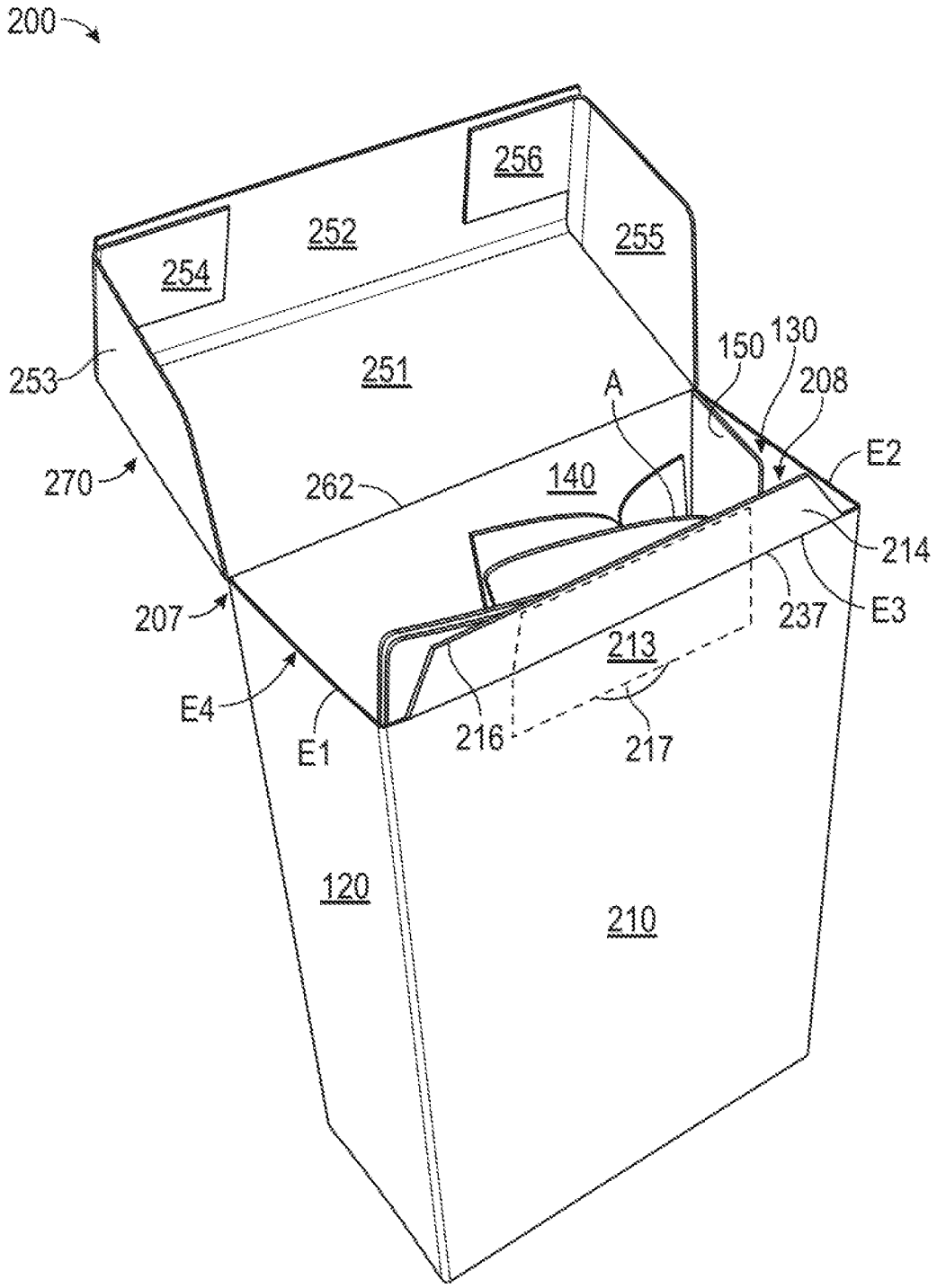
FIG. 9 is a perspective view of the carton of FIG. 8 with an open lid.

In this regard, the hinged lid 270 may be selectively opened (e.g., lifted) or closed (e.g., lowered) with respect to the remainder of the carton 200 via foldable movement of the hinged lid 270 relative to the rear panel 140 at the fold line 262 to provide access to an interior 208 of the carton 200 such that articles A (FIG. 9) can be disposed in the interior 208 of the carton 200. Referring additionally to FIG. 9, as shown, free edges E1, E2 of the respective first side panel 120 and the second side panel 130, and an edge E3 of the carton 200 defined along the fold line 237 form a top edge E4 of the first end 207 of the carton 200. Engagement of at least the proximal portion 251 of the central portion 245 of the end flap 244 with the top edge E4 of the carton 200, for example, the free edges E1, E2, and/or E3, may provide a downward stop for the hinged lid 270 to a closed position (shown in FIG. 8) that inhibits, minimizes, and/or prevents access to the interior 208 of the carton 200. Articles A may be disposed in the interior 208 of the carton 200 prior to or following closure of either or both of ends 207, 209 of carton 200. In this regard, the hinged lid 207 of carton 200 allows a user to open the second end 209 to remove one or more articles A from the interior 208 of carton 200 before reclosing the second end 209.

Figure 7:
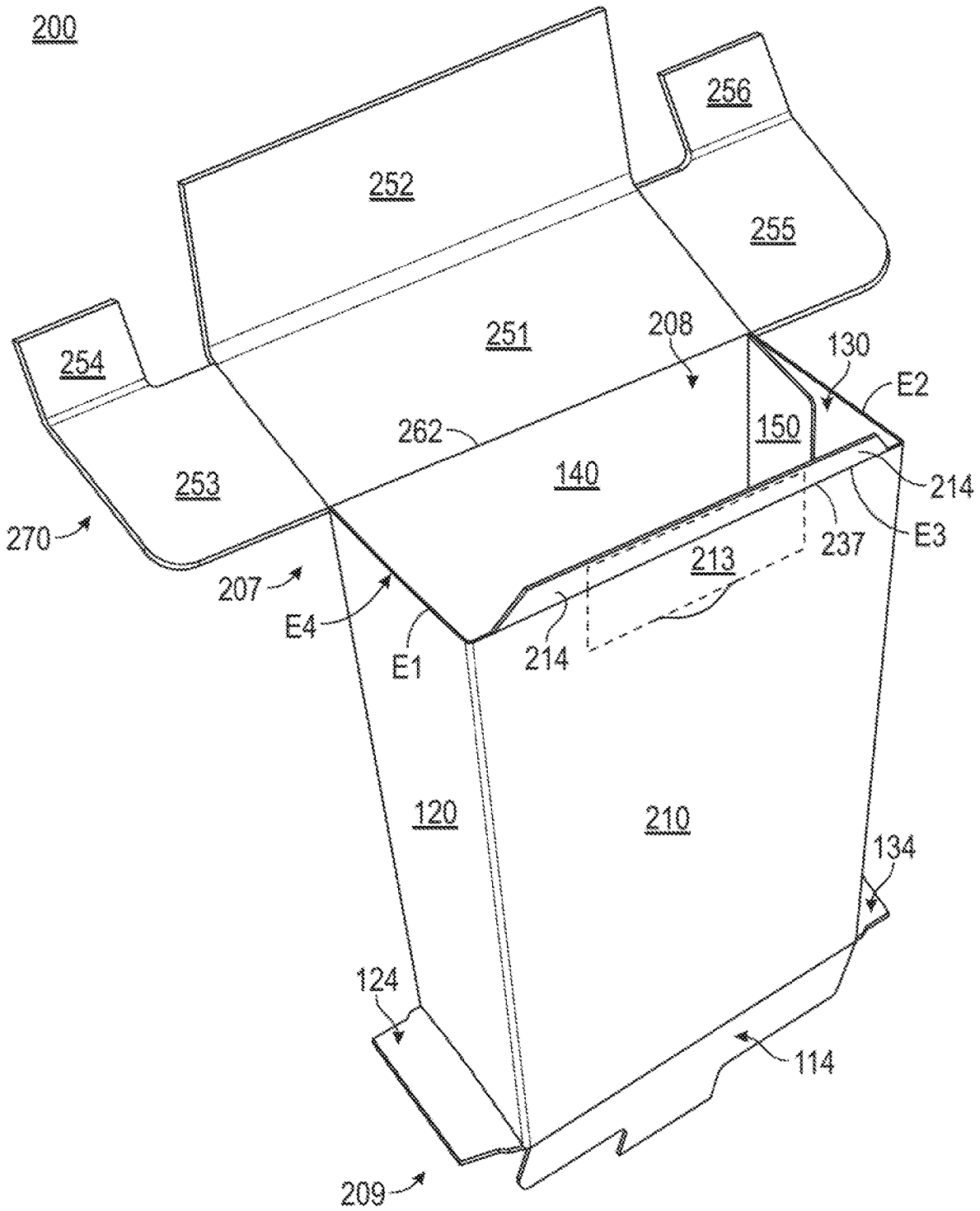
FIG. 7 is a perspective view of a carton assembled from the blank of FIG. 6 in an open configuration according to the second exemplary embodiment of the disclosure.

As also shown in FIGS. 7 and 8, the end flaps 114, 124, 134, 144 may respectively be at least partially overlapped with one another, for example, in at least partial face-to-face contact and secured in such an arrangement, for example, through an adhesive or through one or more interlocking features, to form the second end 209 of carton 200.

Still referring to FIG. 6, and with additional reference to FIG. 9, the carton 200 is shown with the hinged lid 270 in an opened configuration, e.g., spaced apart from the free edges E1, E2, and/or E3, such that the interior 208 of carton 200 is accessible, and with a plurality of articles A stored therein. Articles A may be disposed in a stacked or other arrangement in the interior 208 of carton 200.

Figure 10:
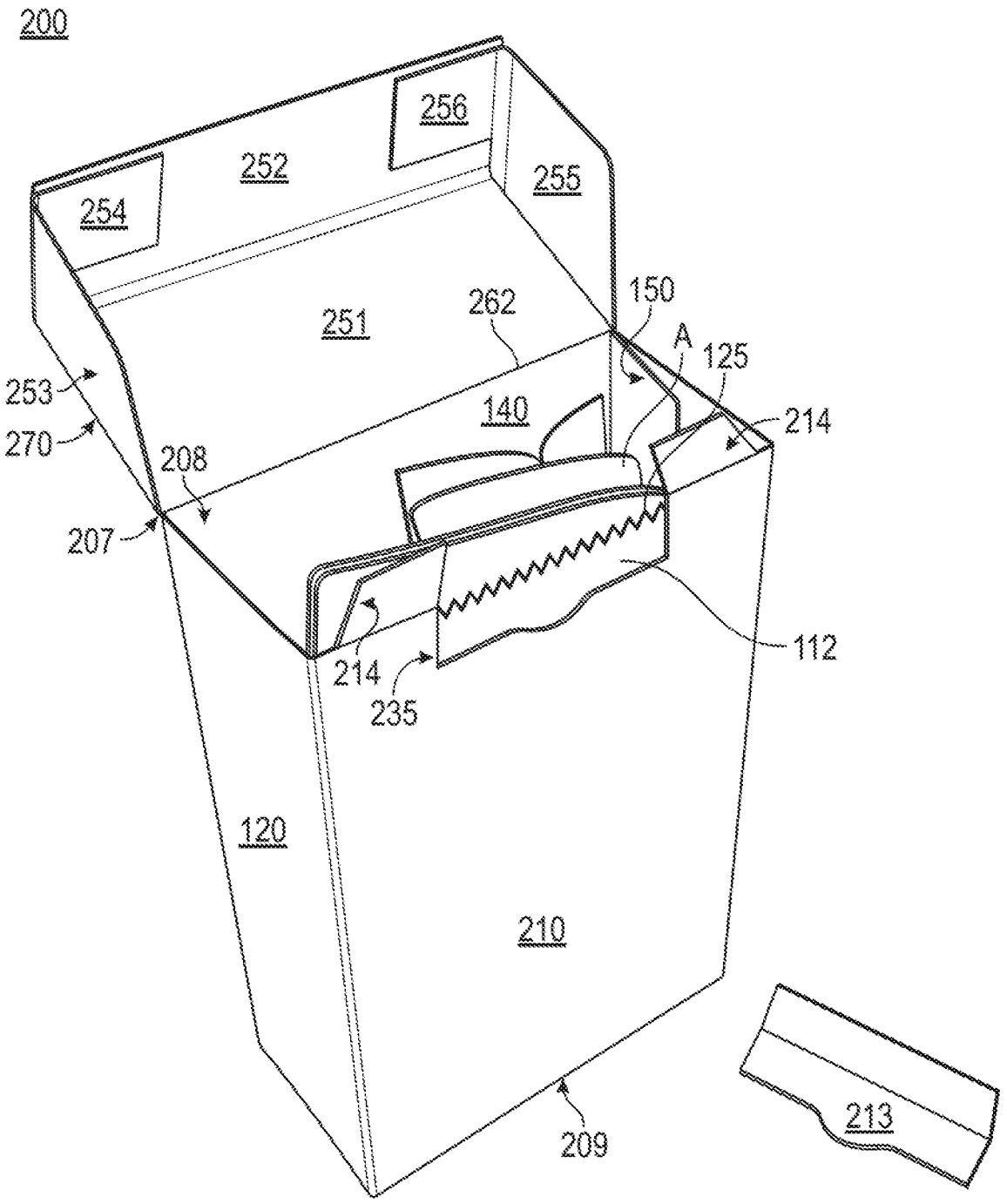
FIG. 10 is a perspective view of the carton of FIG. 9 with an access panel removed.

With continued reference to FIG. 6, and referring to FIG. 10, the access panel 213 can be removed by a user, for example, by inserting one or more of his or her fingers and/or a tool into aperture 117 to engage a portion of the access panel 213, which can be separated from the front panel 210 and/or the end flap 214 at one or more portions 215*a*, 215*b*, 215*c*, 215*d* of the tear line 215 such that the engagement opening 235 into the interior 208 of the carton 200 is provided across portions of the first end 207 and the front panel 210 and with the teeth 125 of engagement features 211 exposed in an upright configuration facing the first end 207 of the carton 200. In this regard, the teeth 125 are presented facing upwardly along an exposed edge of the carton 200 when the access panel 213 is removed. In such a configuration, articles A disposed within the interior 208 of carton 200 may be urged, due to gravity, downwardly and away from the teeth 125 of the engagement features 211 such that articles A disposed in the interior 208 of the carton 200 do not interfere with engagement of other objects against the teeth 125 or other portions of engagement features 211 and a substantially free passage is defined in the interior 208 of the carton 200 between portions of the engagement opening 235 in the first end 207 and the front panel 210, as described further herein.

Figure 11:
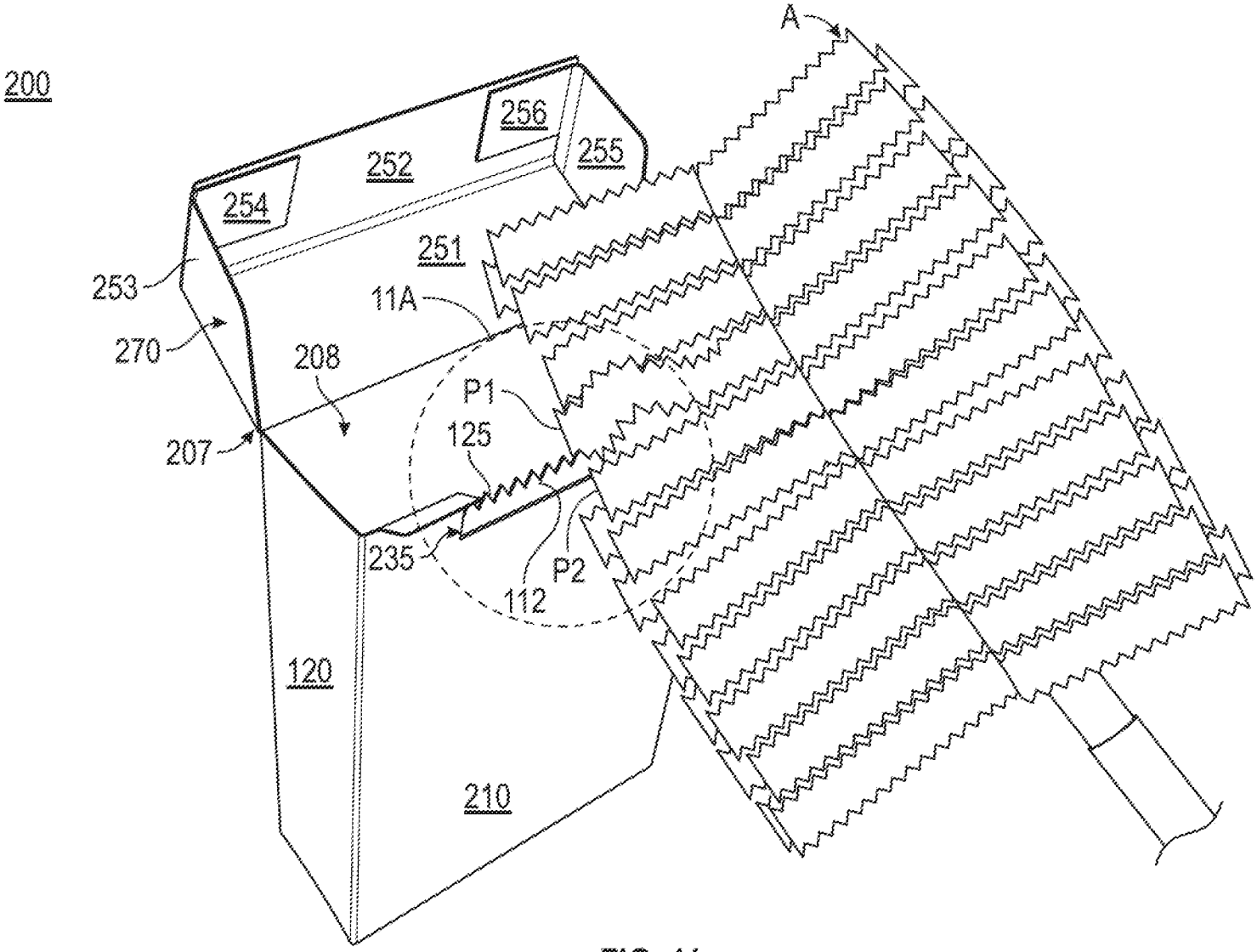
FIG. 11 is a perspective view of the carton of FIG. 10 having an article engaged against a portion of the carton.
Figure 11A:
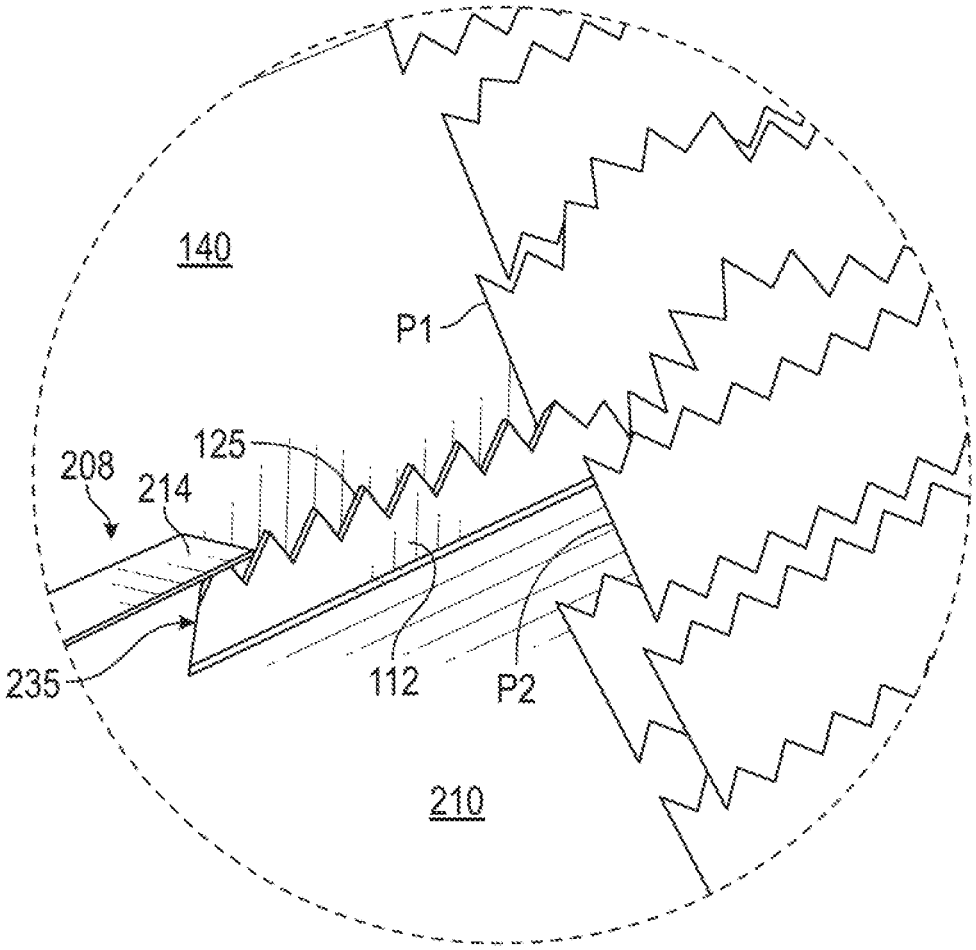
FIG. 11A is a detail view of the area identified in FIG. 11.

Referring additionally to FIGS. 11 and 11A, a method of activating an Article A will be described. After having obtained the carton 200 holding the articles A, a user may access the interior 108 of the carton 200, for example, by opening the hinged lid 270 of the carton 200 as described above, and retrieve and/or remove one or more articles A from the interior 108 of the carton 200. As shown, the fitment 112 is positioned such that a user may activate one or more articles A by engaging or contacting the article with the teeth 125 such that movement of articles A relative to the teeth 125 causes two or more portions, e.g., P1 and P2 as shown, of articles A to activate (i.e., separate, expand, fluff, and/or actuate) relative to one another. In this regard, the teeth 125 are configured to interengage one or more portions of an article A while allowing one or more other portions of article A to continue movement therealong. While an article A has been described as tangentially engaged with the carton 200 against the teeth 125, in embodiments, one or more articles A may be at least partially inserted through the engagement opening 235 and into the interior 208 of carton 200 in the course of contacting the teeth 125 or other portions of the engagement features 211. As shown, portions of the end tab 214 adjacent the engagement opening 235 may provide a guide for movement of one or more articles A therealong. In the course of moving an article A against the teeth 125, the article A can be articulated, e.g., disposed at different angles, relative to the teeth 125 such that the article A is at least partially disposed in the interior 208 of the carton 200.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than articles A without departing from the disclosure.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton;

at least one end flap respectively foldably connected to a respective panel of the plurality of panels for at least partially closing an end of the carton; and an engagement structure attached to at least one panel of the plurality of panels, the engagement structure positioned for receiving the at least one article and activating the at least one article, wherein an access panel is removably connected to the at least one panel and is in face-to-face contact with the engagement structure, the access panel is at least partially defined by at least one tear line in the at least one panel and is separable from the at least one panel to form an engagement opening, wherein the engagement opening is in communication with the interior of the carton and allows access to the engagement structure from the exterior of the carton.

2. The carton of claim 1, wherein the at least one end flap comprises an end flap foldably connected to the at least one panel, the access panel comprises a portion of the at least one panel and a portion of the end flap and is at least partially defined by at least one tear line in the end flap.

3. The carton of claim 2, wherein the end flap is foldably connected to the at least one panel at a fold line, the engagement structure comprises an edge for engaging the at least one article, the edge is adjacent the fold line.

4. The carton of claim 3, wherein the carton comprises a corner at the closed end at least partially defined by the fold line, the engagement opening comprising at least a portion of the corner upon removal of the access panel.

5. The carton of claim 1, wherein the engagement structure is attached to an interior surface of the at least one panel.

6. The carton of claim 1, wherein the engagement structure comprises a polymeric material and the at least one panel comprises paperboard.

7. The carton of claim 1, wherein the engagement structure comprises a plurality of teeth for activating the at least one article.

8. The carton of claim 1, wherein the at least one end flap comprises a first plurality of end flaps for closing a first end of the carton and a second plurality of end flaps for closing a second end of the carton opposite of the first end, the engagement structure is positioned adjacent the first end.

9. The carton of claim 8, wherein the second plurality of end flaps have releasable locking features for opening the second end to remove the at least one article from the interior and reclosing the second end.

10. The carton of claim 1, wherein the plurality of panels comprises a front panel, a first side panel foldably connected to the front panel, a rear panel foldably connected to the first side panel, and a second side panel foldably connected to the front panel, the at least one end flap comprises a first end flap foldably connected to the front panel and a second end flap foldably connected to the rear panel, the second end flap forms a lid foldably connected to the rear panel.

11. The carton of claim 10, wherein the second end flap comprises a central panel foldably connected to the rear panel, at least one proximal portion foldably connected to the central panel, and at least one distal portion foldably connected to the central panel.

12. The carton of claim 10, wherein the first end flap is foldably connected to the front panel at a first fold line, the lid is hingedly connected to the rear panel at a second fold line, the engagement structure is adjacent the first fold line.

13. The carton of claim 12, wherein the first side panel comprises a first free edge at the end of the carton and the second side panel comprise a second free edge at the end of the carton, the first free edge, the second free edge, and the first fold line form a top edge of the end of the carton, the lid is positionable between an open position allowing access to the interior of the carton and a closed position wherein the lid is downwardly folded and in contact with the first top edge and the second top edge.

14. A blank for forming a carton for holding at least one article, the blank comprising:

a plurality of panels for at least partially extending around an interior of the carton formed from the blank;

at least one end flap respectively foldably connected to a respective panel of the plurality of panels for at least partially closing an end of the carton formed from the blank; and an engagement structure attached to at least one panel of the plurality of panels, the engagement structure positioned for receiving the at least one article and activating the at least one article in the carton formed from the blank, wherein an access panel is removably connected to the at least one panel and is in face-to-face contact with the engagement structure, the access panel is at least partially defined by at least one tear line in the at least one panel and is separable from the at least one panel to form an engagement opening, wherein the engagement opening is in communication with the interior of the carton formed from the blank and allows access to the engagement structure from the exterior of the carton formed from the blank.

15. The blank of claim 14, wherein the at least one end flap comprises an end flap foldably connected to the at least one panel, the access panel comprises a portion of the at least one panel and a portion of the end flap and is at least partially defined by at least one tear line in the end flap.

16. The blank of claim 15, wherein the end flap is foldably connected to the at least one panel at a fold line, the engagement structure comprises an edge for engaging the at least one article, the edge is adjacent the fold line.

17. The blank of claim 14, wherein the engagement structure is attached to an interior surface of the at least one panel.

18. The blank of claim 14, wherein the engagement structure comprises a polymeric material and the at least one panel comprises paperboard.

19. The blank of claim 14, wherein the engagement structure comprises a plurality of teeth for activating the at least one article.

20. The blank of claim 14, wherein the at least one end flap comprises a first plurality of end flaps for closing a first end of the carton formed from the blank and a second plurality of end flaps for closing a second end of the carton formed from the blank opposite of the first end, the engagement structure is positioned adjacent the first plurality of end flaps.

21. The blank of claim 20, wherein the second plurality of end flaps have releasable locking features for opening the second end to remove the at least one article from the interior of the carton formed from the blank and reclosing the second end.

22. The blank of claim 14, wherein the plurality of panels comprises a front panel, a first side panel foldably connected to the front panel, a rear panel foldably connected to the first side panel, and a second side panel foldably connected to the front panel, the at least one end flap comprises a first end flap foldably connected to the front panel and a second end flap foldably connected to the rear panel, the second end flap is for forming a lid foldably connected to the rear panel in the carton formed from the blank.

23. The blank of claim 22, wherein the second end flap comprises a central panel foldably connected to the rear panel, at least one proximal portion foldably connected to the central panel, and at least one distal portion foldably connected to the central panel.

24. The blank of claim 22, wherein the first end flap is foldably connected to the front panel at a first fold line, the second end flap is foldably connected to the rear panel at a second fold line, the engagement structure is adjacent the first fold line.

25. The blank of claim 24, wherein the first side panel comprises a first free edge at the end of the carton formed from the blank and the second side panel comprise a second free edge at the end of the carton formed from the blank, the first free edge, the second free edge, and the first fold line form a top edge of the end of the carton formed from the blank, the lid is positionable between an open position allowing access to the interior of the carton and a closed position wherein the lid is downwardly folded and in contact with the first top edge and the second top edge in the carton formed from the blank.

26. A method of forming a carton for holding at least one article, the method comprising:

obtaining a blank comprising a plurality of panels, at least one end flap respectively foldably connected to a respective panel of the plurality of panels, and an engagement structure attached to at least one panel of the plurality of panels, the engagement structure positioned for receiving the at least one article and activating the at least one article;

folding the plurality of panels to at least partially extend around an interior of the carton;

positioning the at least one article in the interior of the carton; and folding the at least one end flap to at least partially form a closed end of the carton, wherein an access panel is removably connected to the at least one panel and is in face-to-face contact with the engagement structure, the access panel is at least partially defined by at least one tear line in the at least one panel and is separable from the at least one panel to form an engagement opening, wherein the engagement opening is in communication with the interior of the carton and allows access to the engagement structure from the exterior of the carton.

27. The method of claim 26, wherein the at least one end flap comprises an end flap foldably connected to the at least one panel, the access panel comprises a portion of the at least one panel and a portion of the end flap and is at least partially defined by at least one tear line in the end flap.

28. The method of claim 27, wherein the end flap is foldably connected to the at least one panel at a fold line, the engagement structure comprises an edge for engaging the at least one article, the edge is adjacent the fold line.

29. The method of claim 28, wherein the folding the at least one end flap comprises forming a corner of the carton at the closed end at least partially defined by the fold line, the engagement opening comprising at least a portion of the corner upon removal of the access panel.

30. The method of claim 26, wherein the engagement structure is attached to an interior surface of the at least one panel, the engagement structure comprises a polymeric material and the at least one panel comprises paperboard.

31. The method of claim 26, wherein the engagement structure comprises a plurality of teeth for activating the at least one article.

32. The method of claim 26, wherein the at least one end flap comprises a first plurality of end flaps and a second plurality of end flaps, the folding the at least one end flap comprises folding the first plurality of end flaps to close a first end of the carton and folding the second plurality of end flaps to close a second end of the carton opposite the first end, the engagement structure is positioned adjacent the first end.

33. The method of claim 32, wherein the second plurality of end flaps have releasable locking features for opening the second end to remove the at least one article from the interior and reclosing the second end.

34. The method of claim 26, wherein the plurality of panels comprises a front panel, a first side panel foldably connected to the front panel, a rear panel foldably connected to the first side panel, and a second side panel foldably connected to the front panel, the at least one end flap comprises a first end flap foldably connected to the front panel and a second end flap foldably connected to the rear panel, the second end flap forms a lid foldably connected to the rear panel.

35. The method of claim 34, wherein the first end flap is foldably connected to the front panel at a first fold line, the lid is hingedly connected to the rear panel at a second fold line, the engagement structure is adjacent the first fold line, the first side panel comprises a first free edge at the end of the carton and the second side panel comprise a second free edge at the end of the carton, the first free edge, the second free edge, and the first fold line form a top edge of the end of the carton, the lid is positionable between an open position allowing access to the interior of the carton and a closed position wherein the lid is downwardly folded and in contact with the first top edge and the second top edge.

36. A method of activating an article, the method comprises:

obtaining a carton holding the article, the carton comprising a plurality of panels that extends at least partially around an interior of the carton, at least one end flap respectively foldably connected to a respective panel of the plurality of panels at least partially closing an end of the carton; and an engagement structure attached to at least one panel of the plurality of panels, wherein the carton comprises an access panel removably connected to the at least one panel and in face-to-face contact with the engagement structure, the access panel is at least partially defined by at least one tear line in the at least one panel;

separating the access panel from the at least one panel to form an engagement opening, wherein the engagement opening is in communication with the interior of the carton and allows access to the engagement structure from the exterior of the carton;

accessing the interior of the carton and removing the article; and engaging the article with the engagement structure to activate the article after the removing the article.

37. The carton of claim 36, wherein the at least one end flap comprises an end flap foldably connected to the at least one panel, the access panel comprises a portion of the at least one panel and a portion of the end flap and is at least partially defined by at least one tear line in the end flap.

38. The method of claim 37, wherein the end flap is foldably connected to the at least one panel at a fold line, the engagement structure comprises an edge for engaging the at least one article, the edge is adjacent the fold line.

39. The method of claim 38, wherein the carton comprises a corner at the closed end at least partially defined by the fold line, the engagement opening comprising at least a portion of the corner upon removal of the access panel.

40. The method of claim 36, wherein the at least one end flap comprises a first plurality of end flaps closing a first end of the carton and a second plurality of end flaps closing a second end of the carton opposite of the first end, the engagement structure is positioned adjacent the first end, the second plurality of end flaps have releasable locking features, the accessing the interior of the carton comprises opening the second end to remove the at least one article from the interior and the method further comprises reclosing the second end.

41. The method of claim 36, wherein the plurality of panels comprises a front panel, a first side panel foldably connected to the front panel, a rear panel foldably connected to the first side panel, and a second side panel foldably connected to the front panel, the at least one end flap comprises a first end flap foldably connected to the front panel and a second end flap foldably connected to the rear panel, the second end flap forms a lid foldably connected to the rear panel.

42. The method of claim 41, wherein the first end flap is foldably connected to the front panel at a first fold line, the lid is hingedly connected to the rear panel at a second fold line, the engagement structure is adjacent the first fold line.

43. The method of claim 42, wherein the first side panel comprises a first free edge at the end of the carton and the second side panel comprise a second free edge at the end of the carton, the first free edge, the second free edge, and the first fold line form a top edge of the end of the carton, the accessing the interior of the carton comprises positioning the lid to an open position spaced apart from the first free edge and the second free edge allowing access to the interior of the carton, the method further comprises positioning the lid to a closed position wherein the lid is downwardly folded and in contact with the first top edge and the second top edge preventing access to the interior.

* * * * *